US005858479A

United States Patent [19]

Saito et al.

[11] Patent Number: 5,858,479

[45] Date of Patent: Jan. 12, 1999

[54] SURFACE TREATING METHOD BY ELECTRIC DISCHARGE

[75] Inventors: Nagao Saito, 12-12, Iwanaridai 9-chome, Kasugai, Aichi 487; Naotake Mouri, 661-51, Yagoto-ishizaka Tenpaku-ku, Nagoya, Aichi 468; Hirotaka Sunada, Nagoya; Takuji Magara; Akihiro Goto, both of Tokyo, all of Japan

[73] Assignees: Japan Science and Technology Corporation, Saitama; Nagao Saito, Kasugai; Naotake Mouri, Nagoya; Mitsubishi Denki Kabushiki Kaisha, Tokyo, all of Japan

[21] Appl. No.: 783,675

[22] Filed: Jan. 15, 1997

[30] Foreign Application Priority Data

Jan. 17, 1996 [JP] Japan ..... 8-00560

[51] Int. Cl.[6] ..... H01T 14/00

[52] U.S. Cl. ..... 427/580; 427/399; 427/540

[58] Field of Search ..... 427/540, 580, 427/399

[56] References Cited

FOREIGN PATENT DOCUMENTS 7-112329 5/1995 Japan .
7-49170 5/1995 Japan .

*Primary Examiner*—Bernard Pianalto
*Attorney, Agent, or Firm*—Sughrue, Mion, Zinn, Macpeak & Seas, PLLC

[57] ABSTRACT

A surface treating method uses an electric discharge machining to form a coating layer having strong adhesion and excellent characteristics on a metal surface such as a hard metal. A discharge electrode is formed by powders containing metal hydride. Electric discharge is generated in a working fluid containing carbon between the discharge electrode and a workpiece. Thus, a coating layer of the metal hydride is formed on a surface of the workpiece.

11 Claims, 4 Drawing Sheets

Results of Friction Wear Test

①② Ground one without surface treatment
③④⑤ Discharged one by Ti metal electrode
⑥ Discharged one by $TiH_2$ green compact electrode
⑦ Discharged one by $TiH_2 + TiB_2$ green compact electrode Abrasion Test Condition Abrasion Test (Ohkoshi Pin-Disc Method)
Pin Shape : 7.98mm$\phi$ (0.5cm$^2$)
Pressing Force : 0.5kgf(1kgf/cm$^2$)
Friction Speed : 1m/s
Disc Material : SK- 3
Atmosphere : Air DEPOSITION (PRIMARY PROCESSING) Hv1410

RE-FUSION PROCESSING (SECONDARY PROCESSING) Hv1750

ENLARGED PHOTOGRAPH OF
RE-FUSION PROCESSING (SECONDARY PROCESSING)

FIG.4

Results of Friction Wear Test

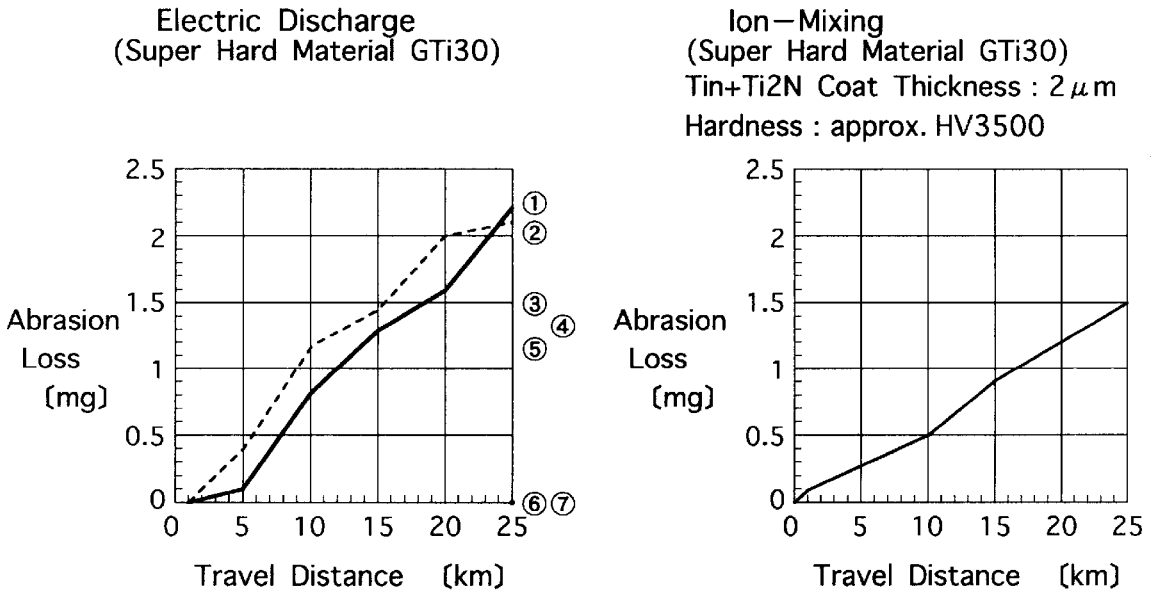

①② Ground one without surface treatment
③④⑤ Discharged one by Ti metal electrode
⑥ Discharged one by $TiH_2$ green compact electrode
⑦ Discharged one by $TiH_2 + TiB_2$ green compact electrode Abrasion Test Condition Abrasion Test (Ohkoshi Pin-Disc Method)
Pin Shape : 7.98mmφ (0.5cm$^2$)
Pressing Force : 0.5kgf(1kgf/cm$^2$)
Friction Speed : 1m/s
Disc Material : SK- 3
Atmosphere : Air

SURFACE TREATING METHOD BY ELECTRIC DISCHARGE

BACKGROUND OF THE INVENTION

1. Field of the Invention

This invention relates to a process for deposit a material with very high abrasion and corrosion resistance on a metal material or a conductive ceramic material, thereby providing a firm coating thereon. Particularly, it relates to a surface treating process for giving high abrasion and corrosion resistance to a metal mold, a tool, machine parts or the like.

2. Description of Related Art

The applicant of this application applied for a patent on a technique for giving corrosion and abrasion resistance by coating a surface of a metal material or the like by deposition by use of an electric discharge machining, and such technique is already well-known. The main point of such conventional technique is as follows.

(1) In one method, an electric discharge is performed in a working fluid by using an electrode which is formed by mixing and compressing powders of WC and Co. After a coating material is deposited on a workpiece, an electric discharge is carried out again by using another electrode, e.g. a copper electrode or a graphite electrode, for melting the coating material. Thus, the coating material is given higher hardness and better adhesion to the workpiece.

(2) In another surface treating method by electric discharge, an electrode is formed by compressing titanium (Ti). In an electric discharge using this electrode, Ti pyrochemically reacts with carbon generated from a working fluid which is thermally decomposed. Then, Ti becomes TiC (titanium carbide), that is a material of very high hardness, and is deposited on a workpiece or a base metal to form a coating thereon. At this time, a metal like Co (cobalt) which can become a binder is added to Ti as a compressed electrode material.

A conventional surface treating technique will be described hereafter referring to FIG. 1 and FIGS. 2*a* and 2*b*. In FIG. 1, step S1 shows a primary processing and step S2 shows a secondary processing. FIG. 2*a* shows the primary processing S1 and FIG. 2*b* shows the secondary processing S2. In the primary processing S1, an electric discharge machining is performed between a green compact electrode 13*v* of a mixture of WC-Co (tungsten-carbide-cobalt) and a workpiece 15 (a base metal S50C) in a working fluid, thereby depositing WC-Co on the workpiece 15. Here, the green compact electrode 13 is joined to a leading end of a copper electrode 11 to define a discharge electrode 10. Next, in the secondary processing S2, the deposited WC-Co layer 17 is re-fused by another electric discharge machining by use of a non-consumable electrode 21 which is hard to wear like a copper electrode.

A structure of the coating layer 17 obtained by the deposition in the primary processing S1 has a hardness of about Hv=1410 and contains many voids. However, the re-fusion in the secondary processing S2 makes the voids in the coating layer 17 disappear and improves the hardness up to Hv=1750 (see FIGS. 3*a*–3*c*).

In the above mentioned methods, the coating powders are deposited very well on a steel with high adhesion. It shows a hardness about 50% higher than that of a sintered hard metal of WC+Co or TiC+Co having the same component. For example, a hardness of a common hard metal tool of WC70+Co30 is Hv=850–950. On the other hand, if such a hard metal of the same component has its surface treated with the electric discharge processing, it shows a hardness of Hv=1710 after the secondary processing.

However, in the conventional methods, it is difficult to form the coating layer having strong adhesion to a surface of a sintered material, e.g. a hard metal bite. Moreover, adhesion strength of the coating layer has large unevenness.

That is, the coating layer adheres well to a steel surface, but hardly sticks to a hard metal surface or the like with the conventional methods. The reason is as follows. Here, main features of the present invention relate to a coating by deposition of Ti and its mixture, so that it is described about Ti why such a phenomenon takes place.

Ti is a metal whose fusing point is 1800° C. and boiling point is 3000° C. or more. Ti is covered with a thin and compact oxide film (Ti—$O_2$) in the air at a normal temperature and chemically stable. That is like aluminum is covered with a compact oxide film $Al_2O_3$. Then, if Ti powders are compressed into an electrode for use in the electric discharge machining (green compact electrode), the following phenomenon takes place.

When an electric discharge is generated between an electrode surface and a workpiece surface, the discharge point becomes a fusing point of a material thereat. At the same time, a working fluid (mineral oil) undergoes explosive decomposition by heat of vaporization. Then, the material at the discharge point is scattered since it is at a high temperature. The scattered material hits a counter electrode, namely, the workpiece surface to be processed. Usually, about 50% of the hitting material is deposited on the workpiece surface.

An electric discharge can be generated though Ti has a thin oxide film in the air. This is because the oxide film is very thin and easy to cause a dielectric breakdown. Namely, the electric discharge is generated by the dielectric breakdown. Then, if a voltage is made high or a distance is made short between the electrodes (discharge electrode and workpiece), potential gradient (V/cm) between the electrodes becomes high to bring forth dielectric breakdown, thereby generating an electric discharge.

This phenomenon can be understood by the fact that a corona discharge is generated at a high-tension transmission line or that a tunnel current flows through a thin oxide film. However, if the distance between the electrodes is made short in order to heighten the potential gradient, an electric discharge takes place and a fused metal swells on the electrode by the discharge pressure. If the swelling metal on one electrode touches with the facing other electrode before it separates from the one electrode, there arises a short circuit between the electrodes and the electric discharge stops. In short, the electric discharge becomes unstable. The applicants have already experienced that the electric discharge is unstable with respect to the Ti electrode or the Ti green compact electrode.

The hot titanium chemically reacts with carbon, which is generated from the decomposed working fluid, during Ti hits the workpiece and until the workpiece surface is covered with the hitting Ti and the first coating is covered with a next hitting Ti. A part of them becomes TiC. If the workpiece is made of a material easy to make an alloy with Ti like a steel and if its fusing point is relatively low compared with a hard metal or the like, Ti is fused well into the base metal (workpiece) or deposited on the base metal while adhering thereto when hitting it. For example, the steel has a fusing point of 1560° C. and a boiling point of 2500° C.

If the secondary processing is performed on the coating obtained by deposition by the same electrode or a different electrode while changing an electrode polarity or electric discharge conditions, the voids caused by the first deposition are crushed and disappear by re-fusion. Thus, it is possible to provide a deposited layer or a coating with high density. Such is described in the former application of the applicants. FIGS. 3*a*–3*c* are micrographs showing a structure of the deposited layer formed in the primary processing and a structure formed after the secondary processing.

However, in case the workpiece is a hard metal (sintered alloy of WC+Co, WC+Co+Ti) or the like, the coating of the Ti green compact is easy to be peeled off from the workpiece surface, even if it is deposited thereon. Namely, Ti is hardly deposited on the workpiece. This fact will be easily understood if considering a welding of metal materials. The steels can be welded by the arc welding. On the other hand, the hard metals cannot be welded by the arc welding. Moreover, the hard metal and the steel cannot be welded by the arc welding.

Still, if a surface of the steel is oxidized, an arc welding thereof is impossible. Therefore, it is common to use a flux for a welding rod or a welding wire to prevent oxidation. On the other hand, there is a material like aluminum which has difficulty in arc welding in the usual state even if its fusing point is low. This is because the surface of aluminum is always covered with a thin and compact film of an aluminum oxide in the air. It is known that welding is possible for the aluminum if the oxide film is destroyed by ultrasonic oscillation or the like.

The reason why Ti of the green compact electrode hitting the workpiece is not deposited on the surface of a hard metal is described hereafter in view of the above phenomenon in welding. It is thought that, since the surface of the Ti powders is covered with a thin oxide film ($TiO_2$), such a film prevents the deposited layer from adhereing to the workpiece. Namely, the smaller a size of the Ti powder is, the larger a ratio of the powder surface area is, compared with a volume of the powder. Therefore, the ratio of the oxide on the powder surface increases.

A similar phenomenon takes place if a quantity of an oxidized surface increases or an oxide adhering to a workpiece largely acts in welding. The above fact can be explained as follows.

The ratio of the powder surface area to the powder volume is shown hereunder.

1) In case the shape of the powder is supposed to be a sphere:
   Surface Area: $S=\pi \cdot d^2$
   Volume of Powder: $V=\pi d^3/6$ (wherein d is a diameter of a powder.)
   Ratio of Surface Area to Volume: $S/V=6/d$
2) In case the shape of the powder is supposed to be a cube:
   Surface Area: $S=6 \cdot d^2$
   Volume of Powder: $V=d^3$ (wherein d is a length of one side.)
   Ratio of Surface Area to Volume: $S/V=6/d$ From the above study, it is understood that, if the size of the powder is smaller, the ratio of the surface area to the volume increases. Therefore, in case the powder surface is closely covered with an oxide film or the like, the smaller the size of the powder is, the more the processing is influenced by the oxide film.

In addition, it is thought that the high fusing point of the hard metal makes welding difficult. This is because the high fusing point makes a fused portion of the hard metal difficult to flow in welding. To the contrary, a fused portion of a steel is easy to flow in welding.

Taking it into account that the oxide layer on the powder surface hinders the deposited layer from fusing and adhering to the workpiece, the compressed powders are easily influenced by an oxide and, if the powder size is smaller, such influence by the oxide becomes larger. Compared with that, in the case of a solid metal titanium electrode, the ratio of an oxide layer to the surface is small. Therefore, it is possible to coat the surface with a metal Ti electrode though it is inefficient.

Ti is deposited on the workpiece rather well in case of the solid Ti electrode. Ti is deposited rather well, too, in case of the electrode sintered or temporarily sintered in a vacuum furnace or the like. However, a depositing quantity (thickness) by the Ti solid electrode or the Ti sintered electrode is small and their adhesion strength is lower compared with a $TiH_2$ green compact electrode described later. Namely, it is supposed that an obstruction factor by an oxide remains unsolved.

As obvious from the above description, in the conventional surface treating method using the electric discharge, the material powders of the green compact electrode of Ti or the like is closely covered with the oxide film ($TiO_2$). Therefore, it is understood that, even if oxygen separates, in part, from the powder surface in the electric discharge, the oxide film still prevents the powdered metal forming the electrode from being deposited on the workpiece surface and fusing with the workpiece metal. Moreover, the thermal decomposition temperature of $TiO_2$ is very high (1800° C.). Thus, when the metal powders of the electrode are scattered due to the electric discharge pressure, many powders hit the workpiece surface in the form of $TiO_2$. In addition, it is necessary to make clearance between the electrodes for generating the electric discharge narrower, since the oxide film makes the electric discharge difficult to generate. Thus, short circuits increase in the surface treating processing. Such being the case, it is understood that the oxide film deteriorates the workpiece surface and affects the processing efficiency.

SUMMARY OF THE INVENTION

An object of the invention is to provide a surface treating method by electric discharge machining that makes material powders deposited well on a workpiece like a sintered hard metal with strong adhesion, that prevents short circuits during processing, that improves processing efficiency, and that provides a fine and beautiful finished surface.

According to one preferred mode of the invention, there is provided a surface treating method by electric discharge. In this method, a discharge electrode is positioned so as to face a workpiece. The discharge electrode is made by forming material powders containing at least powders of a hydride of a metal. Next, electric discharge is generated between the discharge electrode and the workpiece in a working fluid containing carbon therein. Thus, a coating layer containing the hydride is formed on a surface of the workpiece.

BRIEF DESCRIPTION OF THE DRAWINGS

FIG. 2*a* is an explanatory view showing a principle of a secondary processing of FIG. 1.

FIG. 4 show graphs for comparison of results of abrasion tests between an inventive surface treating method and a conventional one.

DESCRIPTION OF THE PREFERRED EMBODIMENT

<First Embodiment>

Figure 1:
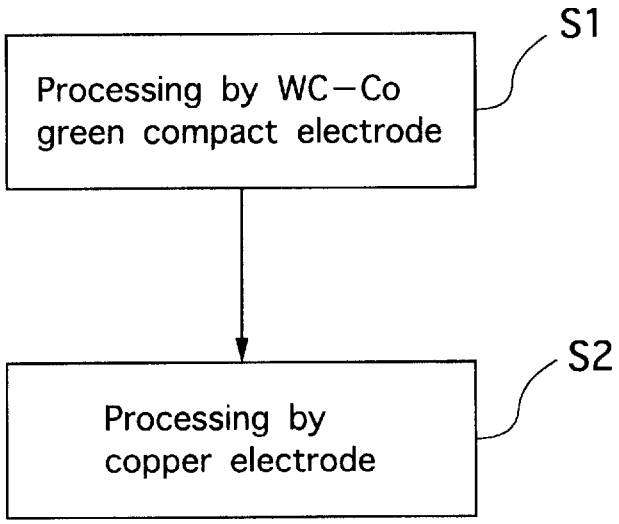
FIG. 1 is a flowchart of a conventional surface treating method using a green compact electrode of a mixture of WC+Co.
Figure 2A:
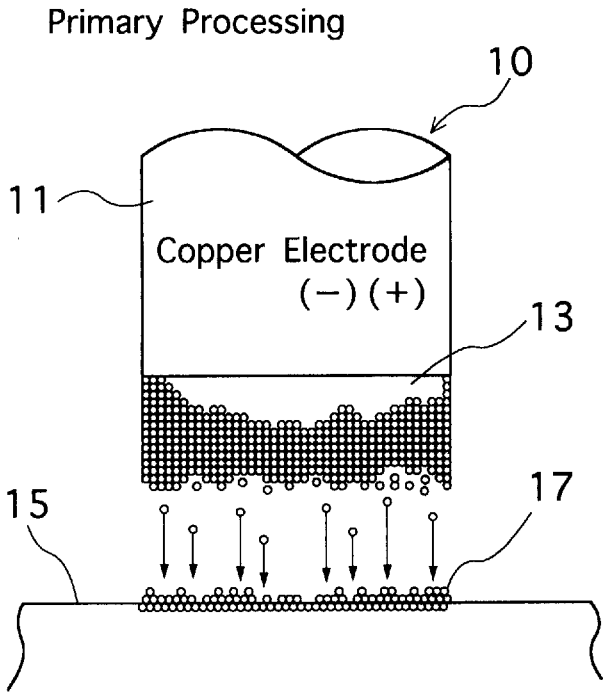
FIG. 2*a* is an explanatory view showing a principle of a primary processing of FIG. 1.
Figure 2B:
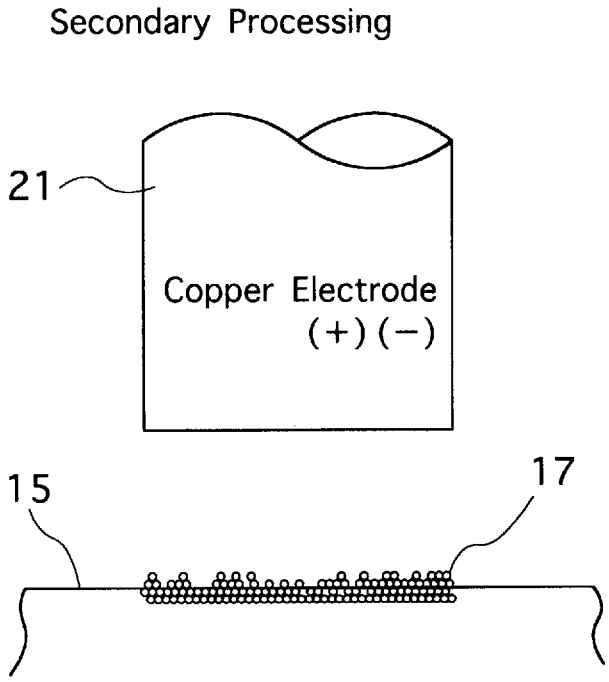
Figure 3A:
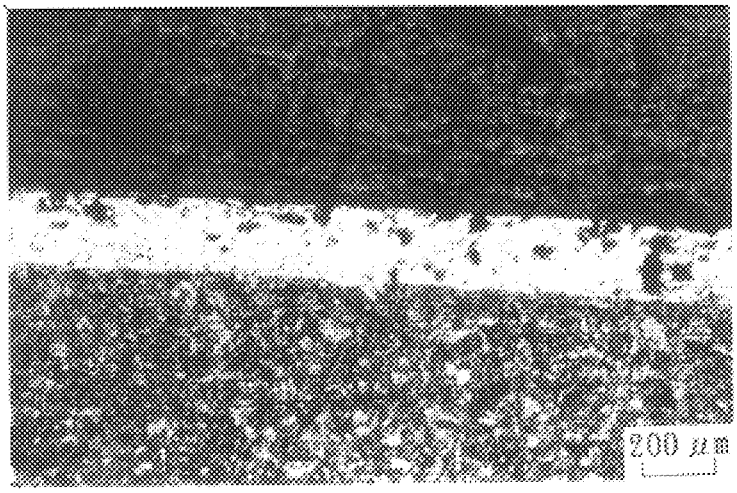
FIG. 3*a* is a micrograph showing a section of a processed layer of a workpiece after the primary processing of FIG. 1.
Figure 3B:
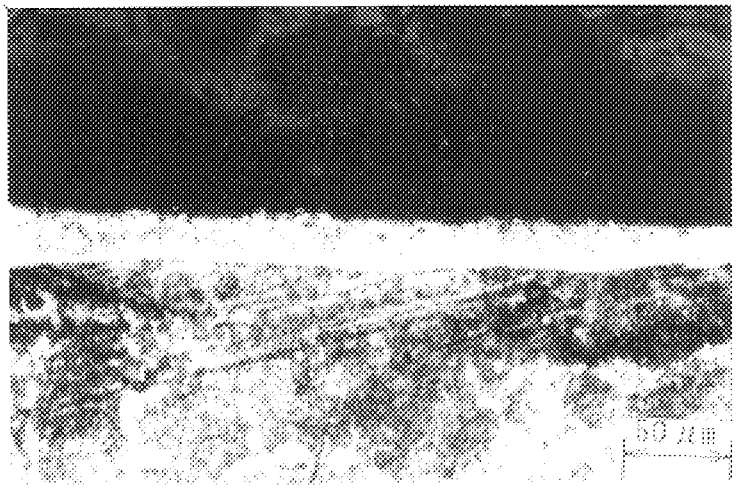
FIG. 3*b* is a micrograph showing a section of a processed layer of a workpiece after the secondary processing of FIG. 1.
Figure 3C:
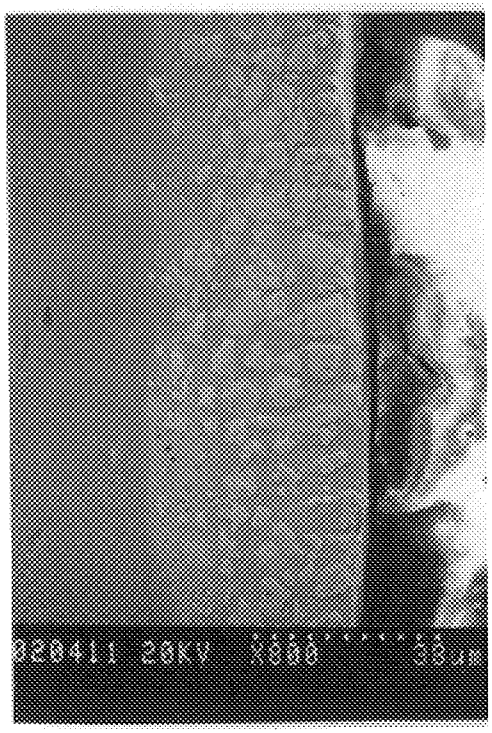
FIG. 3*c* is a enlarged micrograph of FIG. 3*b*.

The first embodiment of surface treating method of the invention uses $TiH_2$ green compact electrode for electric discharge machining. The $TiH_2$ green compact electrode is made by compressing powders of $TiH_2$ having a predetermined grain size under a prescribed pressure. The green compact electrode is normally formed into a disc shape of a fixed diameter and thickness. Then, the disc shaped green compact is joined to a leading end of a solid metal electrode such as a copper rod via a conductive adhesive. Thus, an electric discharge electrode of $TiH_2$ is obtained. The $TiH_2$ green compact electrode is used for surface treatment of a predetermined hard metal as a workpiece. In such treatment, an electric discharge is generated in a working fluid between the $TiH_2$ green compact electrode and the hard metal under a fixed condition. The working fluid contains therein carbon or includes a polymeric material which is thermally decomposed to generate carbon. Specifically, the polymeric material is composed of a mineral oil and fat or a vegetable oil and fat. This processing corresponds to the primary processing of the conventional surface treating processing shown in step S1 of FIG. 1, though the processing conditions are different therefrom.

Characteristic function and effects of the inventive surface treating method is described hereafter in which $TiH_2$ green compact is used for the electrode.

Hydrogen begins to separate from $TiH_2$ at a temperature of 300° C. or more. It is supposed that a surface of the workpiece at a discharge point is kept at its boiling point during the electric discharge, which usually continues for 0.1 microsecond to 1,000 microsecond. Then, $TiH_2$ is completely decomposed.

At this time, Ti and decomposed hydrogen exhibit a very active chemical reaction. Namely, hydrogen compound like $TiH_2$ is unstable and reacts with high activity. This is true in view of common knowledge of the chemical change.

More in detail, an oxide or the like exists even on the surface of a hard metal and a steel or the like, though it may not be closely stuck thereto. Then, the hydrogen at nascent state strikes the workpiece surface and removes or cleans an oxide film or the like which exists on the workpiece surface.

In addition, Ti, which has no oxide thereon and keeps high activity, hits the workpiece surface, so that Ti can be deposited on the workpiece with strong adhesion. Moreover, $TiH_2$ is inherently fragile, so that it will be broken into fine particles when the electric discharge is generated, and become smaller than an original grain size of $TiH_2$. Therefore, $TiH_2$ improves a finished surface roughness of the workpiece and makes it finer than that obtained by the conventional WC-Co green compact, if the processing is performed under the same electrical condition. With the conventional electrode, the surface roughness is 30–40 $\mu$ mRmax. On the other hand, with the inventive electrode, the surface roughness can be 6–12 $\mu$ mRmax.

Moreover, a surface of the workpiece is initially cleaned by the hydrogen at nascent state, then the $TiH_2$ powders are deposited on such a clean workpiece metal surface. After a first cycle of processing, all the workpiece metal surface is coated with Ti or TiC. Here, TiC is made by chemical combination of Ti with carbon due to oil decomposition. Then, such a Ti or TiC surface defines a workpiece surface to be treated by the following electric discharge. This means that there are no particles covered by such Ti as contains $TiO_2$, contrary to the prior art. Therefore, deposited layers obtained by the following coating steps are joined to the first layer with very strong adhesion. From the above facts, the coating layer in the present embodiment shows extremely strong adhesion to the hard metal. An abrasion test proves that it shows excellent antiwearing effects which have not been obtained conventionally.

Here, it is impossible to weld hard metals by the common arc welding. However, in the electric discharge machining, the discharge point reaches a boiling point of the hard metal material. Moreover, its energy density is hundreds times higher than that in the arc welding or the like. Thus, the coating layer will closely stick even to the hard metal, if the metal surface is cleaned as mentioned above.

<FIRST EXAMPLE>

The $TiH_2$ green compact electrode was fabricated as follows. First, powders of $TiH_2$ having a grain size of 10 micron or less were compressed under a pressure of 11.4 ton (about 6,500 kg/cm$^2$) into a disc shape of 15 mm diameter and about 5 mm thick. Thus formed green compact disc was joined to an end of a copper rod via a conductive adhesive to define an electric discharge electrode. A hard metal of WC+TiC+Co (GTi30, Mitsubishi Material Inc.) was used as a workpiece.

Then, an electric discharge was generated between the $TiH_2$ green compact electrode and the hard metal under the following conditions, thereby forming a deposited layer on the workpiece surface. Here, the surface treating by the electric discharge machining was performed only by use of the $TiH_2$ green compact electrode, which corresponds to the primary processing of the conventional method.

1) Processing Conditions; Hardness, Roughness of Finished Surface; Results of Abrasion Test i) Processing Conditions:
- Discharge Current: Ip=3.5 A
- Pulse Width: $\tau p$=32 $\mu$s
- Processing Period: 2 minutes
- Electrode Polarity: Minus (−)

ii) Hardness, Roughness of Finished Surface:
- Vickers Hardness: Hv=600–900 (measuring pressure of 10 g)
- Thickness of Deposited Layer: 13 $\mu$m
- Roughness of Finished Surface: 10 $\mu$mRz iii) Results of Abrasion Test (Ohkoshi Pin-Disc Method):
- Atmosphere: Air Atmosphere
- Pin Shape: $\phi$7.98 mm (0.5 cm$^2$)
- Pressing Force: 0.5 Kgf
- Pressure: 1 Kgf/cm$^2$
- Friction Velocity: 1 m/s
- Disc Material: SKH-3

FIG. 4 shows results of friction wear test for the workpiece surface treated by the first example of surface treating method together with various comparison examples. The graphs in FIG. 4 show results after the abrasion test of a travel distance of 25 Km.

With the surface treating according to the first example, abrasion loss of 0 mg was obtained for the workpiece, as shown by ⑥ and ⑦ of FIG. 4.

Abrasion losses for the hard metal materials treated by other methods are shown hereunder for comparison of the results of the abrasion test with the first example.

Abrasion loss of a hard metal (GTi30) with a test surface ground was 2.1 mg (① and ② of FIG. 4) wherein the solid line shows the case of ① while the broken line shows the case of ②.

Abrasion loss of the hard metal with a test surface treated by electric discharge with a titanium electrode was 0.7–1.5 mg (③, ④ and ⑤ of FIG. 4).

Abrasion loss of the hard metal with a test surface treated by ion mixing of TiN+$Ti_2N$ (film thickness 2 μm) was 1.5 mg.

(N.B.) Resolution to measure the abrasion loss is approximately 0.1 mg.

The hardness Hv=600–900 obtained in the first example merely corresponds to a hardness of a quenched steel or a tempered steel. However, its abrasion resistance is very high. On the other hand, the hardness of the hard metal as the base material is high or about Hv=1500–1800. However, the hard metal whose surface is only ground is worn by 2.1 mg, as shown in the above result.

2) Study of Extreme Improvement in Abrasion Resistance i) There is no clear analysis now why such high abrasion resistance can be obtained in spite of the low hardness. Nevertheless, the inventors of this application suppose as follows. A surface of a deposited layer formed in the electric discharge machining by use of the $TiH_2$ green compact is composed of Ti and TiC. Thus, the deposited layer adheres closely to the surface of the hard metal as the base metal without containing any oxide therein.

Even the surface of the hard metal can reach its boiling point for a moment by the electric discharge thereat, so that the deposited Ti and TiC can diffuse to and fuse in the base metal) to a certain degree. The deposited layer is composed of Ti and TiC, from its inside surface (a boundary surface to the base metal to its outside surface. In this case, a thickness of the deposited layer is about 13 μm. The deposited layer adheres closely to the base metal since it contains no oxide. The Ti component on the outermost surface of the deposited layer is oxidized in the air and becomes $TiO_2$. However, the inside of the deposited layer is kept as Ti having activity.

Therefore, it is supposed that, after the outermost surface of the deposited layer is worn and removed by the touching disc material (SK-3) in the abrasion test, the disc material is removed in turn and fused into the Ti deposited layer side. Then, the fused disc material transfers and adheres to the base metal surface coated with the Ti layer. To our understanding, the transferred disc material (SK-3) adheres to and protects the rather soft Ti surface, while the hard TiC also exists on the deposited layer surface together with the Ti.

ii) In the above study, it is necessary to logically describe differences between adhesion in a surface treatment by an electrical plating and adhesion in the inventive surface treatment, and between cleaning effect by decomposed hydrogen of the working fluid in the electric discharge and cleaning effect of the hydrogen of $TiH_2$. In case of the electric plating, a plating metal is deposited on a negative electrode. In this case, the negative electrode surface should be cleaned by the hydrogen generated when the water solution of the metal plating is decomposed. However, the adhesion of the plating metal to a base metal is not so high. Moreover, it is known that the base metal and the plated surface become fragile by hydrogen embrittlement. It can be thought that the plating metal can not diffuse to and fuse in the base metal, because the processing is not performed at a high temperature and a high pressure, though the plated base metal surface may be cleaned.

iii) In case of a working oil is decomposed by the electric discharge machining, it is said that, since carbon and hydrogen are generated while much carbon is deposited on a positive electrode, the negative electrode surface is cleaned by the hydrogen hitting it.

This effect can not be ignored. It is true that, when the metal powders of WC+Co electrode are deposited on a steel surface, the deposited layer has extremely high adhesion. However, though an attempt was made to deposit the WC+Co powders on a hard metal surface, high adhesion could not be obtained.

In addition, though another attempt was made to deposit titanium powders on a steel material by using a green compact electrode made of only the titanium powders. However, any conditions for good deposition could not be found.

Prom the above test results and the fact that the metal powders could not be deposited on the hard metal even after the cleaning of the metal surface by the hydrogen generated in the electric discharge machining, it is supposed that reduction reaction is impossible for the metal powders whose surface is covered with an oxide film such as titanium powders.

<SECOND EXAMPLE>

An electric discharge was generated between a $TiH_2$ green compact electrode and a hard metal as a workpiece under some different conditions shown below, thereby forming a deposited coating layer on the workpiece surface. The $TiH_2$ green compact electrode was made of $TiH_2$ powders in the same manner as the first example. The hard metal may be the same as that of the first example, too. Here, the surface treating by the electric discharge was performed only by the $TiH_2$ green compact electrode, which corresponds to the primary processing of the conventional method.

A coating layer obtained in this processing was tested. Test results are shown below with respect to cases in which electric discharge conditions are changed.

1) In case of changing electrode polarity:

i) Green Compact Electrode Polarity: Minus (−)
Discharge Current: Ip=10 A
Pulse Width: τp=32 μs
Processing Period: 5 minutes
Hardness of Processed Surface: Hv=670–900
(Measuring Pressure: 10 g)

ii) Green Compact Electrode Polarity: Plus (+)
Electric Conditions: Same as above (i)
Hardness of Processed Surface: Hv=1450–1550
(Measuring Pressure: 10 g)

It was proved that the hardness of the processed surface varies according to polarity change of the electrode as shown in the above cases 1) and 2).

2) In case electric discharge current is made large while its pulse width is made very small.

Discharge Current: Ip=45 A
Pulse Width: rp=0.5 μs
Processing Period: 2 minutes
Green Compact Electrode Polarity: Minus (−)
Hardness of Processed Surface: Hv=2000–3000
(Measuring Pressure: 10 g)
Hardness of Processed Surface: Hv=1300–2000
(Measuring Pressure: 50 g)
Deposited Layer Thickness: 2 μm
Roughness of Finished Surface: 6 μmRz The hardness was large when the measuring pressure was small. On the other hand, the hardness was a little small or the processed surface was a little soft when the measuring pressure was large. It means that the deposited layer tends to have a hard surface while its inside is a little soft. Namely, the deposited layer has a hardness inclination. It is said that such a hardness inclination makes the deposited layer strong against thermal expansion and shock and the like in practical use.

3) In view of the test results of 1) and 2), there may be several ways to make the surface of the deposited layer very hard while making the layer gradually softer at the inside, thereby increasing the hardness inclination to a great degree. One way is to perform the electric discharge machining under the condition of i) of 1), then performing the next electric discharge machining under the condition of 2). Another way is to change the electrode polarity, e.g. from minus (condition i) of 1)) to plus (condition ii) of 1)), or the like.

<THIRD EXAMPLE >

A steel (SK-3) was used as a workpiece to be processed. A surface of the steel was treated with a primary electric discharge machining and a secondary electric discharge machining as in the conventional method. Coating layers obtained in these two processings were tested, respectively. Test results are shown below.

1) Surface treatment was performed on the steel by the electric discharge by use of a $TiH_2$ green compact electrode, as the primary processing. The $TiH_2$ green compact electrode was same as that of the first example. The processing condition was same as that of the first example, too.

Discharge Current: Ip=3.5 A

Pulse Width: rp=32 $\mu$s

Processing Period: 5 minutes

Hardness of Processed Surface: Hv=900–1000

(Measuring Pressure: 10 g)

Deposited Layer Thickness: 47 $\mu$m

Abrasion Loss after Abrasion Test: 0 mg

2) After the primary processing under the above condition shown in 1), the secondary processing was made on the steel (SK-3) by using a graphite electrode. The secondary processing conditions were as follows:

Discharge Current: Ip=3.5 A

Pulse Width: $\tau$p=4 $\mu$s

Processing Period: 5 minutes

Graphite Electrode Polarity: Minus (–)

Hardness of Processed Surface: Hv=1600–1750

It can be understood from the above result that the secondary processing extremely increases the hardness of the workpiece surface. A copper electrode may be used in the secondary processing instead of the graphite electrode. In case of the copper electrode, the hardness of the workpiece surface was increased to the same degree.

This is because C (carbon) generated from the decomposed working oil is combined with Ti residue in the coating layer, thereby enlarging the ratio of TiC occupying in the coating layer, though new Ti or TiC is not deposited on the workpiece surface in the secondary processing.

<Second Embodiment>

The second embodiment uses a green compact electrode made by mixing $TiH_2$ with other metal, carbide, nitride or boride. Such a mixture extends the above mentioned excellent characteristics of $TiH_2$. Many experiments were performed to form a variety of green compact electrodes by mixing the followings into the $TiH_2$ powders, respectively.

1) Metal having a possibility of becoming carbide by electric discharge machining (e.g. Ta, Nb, V, Zr)

2) Carbide (e.g. TiC, TaC, NbC, VC, BC, $B_4C$)

3) Nitride (e.g. TiN, HBN, CBN)

4) Boride (e.g. $TiB_2$, boric acid ($H_2BO_3$), borax ($Na_2B_4O_7.10H_2O$))

5) Yttria ($Y_2O_3$)

As typical examples among them, tests were carried out for an electrode of a mixture of $TiH_2$ and $TiB_2$, an electrode of a mixture of $TiH_2$ and TiN, and an electrode of a mixture of $TiH_2$, $TiB_2$ and TiN, respectively, as shown below. In the tests, a hard metal like that of the first example was used as a workpiece to be processed. A surface of the hard metal was treated with a primary electric discharge machining as in the first example. Otherwise, the hard metal was further processed by a secondary electric discharge machining as in the third example. Coating layers obtained in these two cases were tested, respectively. Test results will be shown later as fourth to sixth embodiments.

Here, the tests proved the followings. Namely, with only the primary processing, the hardness of the workpiece surface exceeded the hardness of the hard metal itself. However, it was found that the secondary processing by use of a graphite electrode or the like improved the hardness more. It may be good to use a copper electrode or tungsten electrode or the like instead of the graphite electrode. With the secondary processing, the processed hard metal had a hardness inclination that the hardness at its surface was ½ of diamond (same as CBN, Hv 5000 or more) while its inside became soft.

<FOURTH EXAMPLE>

Electrode Material: $TiH_2$+$TiB_2$ (7:3 weight ratio)

1) A $TiH_2$+$TiB_2$ green compact electrode was fabricated in the same manner as the electrode of first example. With only the primary processing using this electrode, the following result was obtained under the condition shown below.

Electrical Condition: Ip=5.5 A, $\tau$p=32 $\mu$s

Processing Period: 5 minutes

Hardness: Hv=1850–2500 (Pressure: 10 g)

Thickness: 24–28 $\mu$m

Hardness: Hv=1650–2500 (Pressure: 50 g)

As a result of an abrasion test which was performed in the same way as the first example, the abrasion loss of the workpiece surface was 0 mg.

In addition, the above electric discharge processing was performed on a cutting face and a front flank of a hard bite (Mitsubishi Material Inc. UTi20 ), respectively, for two minutes. Then, adaptability to a cutting tool was tested by performing a cutting test by using a lathe. As a result, the processed bite showed a lifetime 1.9 times as long as that of a bite without the electric discharge processing, under a cutting condition shown below.

Moreover, another test was carried out while changing the electric discharge conditions as follows:

Electrical Condition: Ip=8 A, $\tau$p=8 $\mu$s

Processing Period: 5 minutes

Thus processed bite showed a lifetime 2.8 times as long as that of a bite without the electric discharge processing, under the cutting condition shown below.

Cutting Condition:

Material for Cutting: S45C

Depth of Cutting: 0.5 mm

Feed: 0.3 mm/rev
Cutting Speed: 160 m/min
Dry Cutting
Lifetime Decision: Abraded Width of Front Flank at Cutting Distance of 7 km (shown as VB commonly)

2) After the primary processing, the secondary processing was performed by use of the graphite electrode for five minutes under the following conditions:

Electrical Condition: Ip=3.5 A, τp=4 μs

Processing Period: 5 minutes

Green Compact Electrode Polarity: Minus (−)

Hardness: Hv=2100–5100 (Pressure: 10 g)

Hardness: Hv=1500–3000 (Pressure: 50 g)

Thickness: 32–36 μm

The hardness Hv=5000 is next to the diamond hardness Hv=10000, and equal to the CBN hardness Hv=5000. In this case, the coating layer also shows an inclined hardness distribution that the coating layer has a very hard surface while becoming softer gradually toward the inside. The coating layer has both characteristics of surface hardness and toughness, so that it is very useful.

<FIFTH EXAMPLE>

Electrode Material: $TiH_2$+TiN (7:3 weight ratio)

1) Primary Processing Condition:
Electrical Condition: Ip=5.5 A, τp=32 μs
Processing Period: 5 minutes
Electrode Polarity: Minus (−)

Hardness: Hv=1050–1800 (Pressure: 10 g)

With only the primary processing, the coating layer showed high hardness not equal to but next to the coating layer obtained by use of the $TiH_2$+$TiB_2$ green compact electrode of the fourth example.

2) Where the secondary processing is performed by use of the graphite electrode after the primary processing, hardness of the coating layer became about Hv=1700–2300.

<SIXTH EXAMPLE>

Electrode Material: $TiH_2$+$TiB_2$+TiN (2:1:1)

1) Hardness with only the Primary Processing

Processing condition was the same as that of the first example, while a processing period was 5 minutes.

Hardness: Hv=2000–2300 (Pressure: 10 g)

Thickness: 12–18 μm

2) Hardness in case of the secondary processing additionally performed by use of the graphite electrode:

Processing Condition was the same as that of the first example, while a processing period was 5 minutes.

Hardness: Hv=2550–6050 (Pressure: 10 g)

Thickness: 14–18 μm

If the measuring pressure was set high (50 g), the hardness was lowered to about Hv=1800. Therefore, it is clear that the coating layer has also hardness inclination.

<Third Embodiment>

It is an object of the first and second embodiments to heighten abrasion resistance of a workpiece. The primary processing by the $TiH_2$ green compact electrode resulted in high abrasion resistance, though the hardness was not so high. To our understanding, this is because adhesion of the deposited layer is very strong. Moreover, in case of adding $TiB_2$ or the like to $TiH_2$, the coating layer showed high hardness and high abrasion resistance.

On the other hand, in case there is a fear of brittle fracture due to too high hardness, it is effective to add Nb, Ta or NbC, TaC or the like to give toughness. This is a technique known to the hard metal tool industry.

A surface treating processing was performed under the same condition as that of the first example while adding Ta, Nb and V to $TiH_2$, respectively, in about ten percent by weight ratio. As a result, in case of Ta, Nb, hardness was Hv=600–700. In case of V, hardness was Hv=900. Namely, the hardness did not increase in either case. However, when the coating surface was hit by a hammer or the like, it was difficult to damage or break the coating surface. Therefore, it is understood that the toughness of the coating layer is improved. The coating layer was deposited well and the depositing processing was stable. The thickness of the deposited layer was 10–20 μm after a five-minute processing.

It is said that Nb, TaC, VC or the like is also effective to improve toughness of a cutting tool for its intermittent cutting. Therefore, they were added to $TiH_2$, respectively, in about 10 percent by weight ratio in this test. As a result, the hardness was about Hv=900–1050 and not very high. However, the coating layer was deposited well and the depositing processing was stable. The thickness of the deposited layer was about 20–30 μm after a five-minute processing. The coating layer was strong and tough against hitting or the like.

<Fourth Embodiment>

As described above, it is clear that a deposited layer of higher hardness can be obtained on the workpiece surface by using $TiH_2$ alone or by adding simple substance such as $TiB_2$ or TiN to $TiH_2$ as a base material. As described before, the reason why $TiH_2$ adheres to the base metal is that the workpiece surface to be coated is reduced by hydrogen ions generated when the hydride is decomposed. Moreover, it also contributes to the better adhesion of $TiH_2$ that the decomposed Ti is activated to a large degree. Furthermore, it is supposed that, since Ti is fined when the electric discharge is generated, effective touching area of Ti to the base metal is enlarged, thereby improving the $TiH_2$ adhesion. In addition, there is a characteristic that, since the Ti is fined and the deposited structure is made fine accordingly, roughness of the finished surface tends to be fine.

With the above principle developed, a metal hydride can be used for a surface processing. The hydride applicable to the surface processing is as follows:

$ZrH_2$, VH, $VH_2$, NbH, TaH, $FeTiH_2$, $LaNi_5H_6$, $TiMnH_2$, $NaBH_4$

As one example of the above metal hydrides, an experiment was made for $ZrH_2$, and its result is described hereafter as a seventh example. Zr is excellent in heat resistance and corrosion resistance and used in a nuclear reactor as a moderator of thermal neutrons. It is used in a cutting tool, a bearing, heat and abrasion resistant parts of a heat engine, parts of a pump or the like.

<SEVENTH EXAMPLE>

A green compact electrode was made of $ZrH_2$ powders under the same conditions as the first example: compression pressure of 6500 kg/cm$^2$. A steel material SK-3 as a workpiece was processed by the $ZrH_2$ green compact electrode under an electrical condition: Ip=5.5 A and τp=32 μs. As a result, $ZrH_2$ powders were deposited on the workpiece in a very stable processing state. Five-minute processing made a deposited layer of a thickness of 8–10 μm and a hardness of Hv=660–690. Though the hardness was not very high, the deposited layer showed high abrasion resistance.

In case the deposited layer of high hardness is necessary, a secondary processing is performed by using a graphite electrode or the like as in the before-mentioned example. The secondary processing increases hardness of the deposited layer. Electrical conditions in the secondary processing were: Ip=3.5 A, τp=4 μs, graphite electrode (-). Thereby, a hardness of Hv=1350–2000–2350 was obtained.

<Fifth Embodiments>

In some cases, aluminum, zinc or steel (especially, mild steel) needs to have its surface given high abrasion resistance while it is not necessary to have the surface hardness so high. For example, it is sometimes desired to give enough abrasion resistance, while the hardness being not so high, to a surface of an anti-wearing part of an aluminum engine, a surface of a mold formed by zinc and a surface of a mechanical part made of a mild steel. In such a case, a discharge electrode is made by mixing powders of $TiH_2$ and powders of a metal of a base material which needs surface processing. If the surface of the metal is processed by electric discharge machining with thus fabricated electrode, the metal surface is coated with a film having high adhesion and higher hardness than that of the base material.

As a specific example, processing of aluminum by use of a $TiH_2$+Al green compact electrode will be described hereafter.

<Eighth Example>

A green compact electrode was made by mixing powders of a workpiece (an aluminum die casting material including 11% of Si) in $TiH_2$ powders. The mixture ratio of $TiH_2$:Al was 3:7 by weight ratio. In case of an electrical condition of about Ip=5 A and τp=32 μs, the hardness of the workpiece surface layer is about Hv=400–600. In case of an electrical condition of about Ip=20 A and τp=260 μs, the hardness of the surface layer reaches a level of about Hv=1400. The same result can be obtained even if the above processing is performed for zinc by using the electrode of the same composition.

<Sixth Embodiments>

There is so called a super resisting alloy (super alloy) in non-ferrous metals, which is also an object of the surface treating by the electric discharge machining. Namely, a material made of Ti, 6 percent Al and 4 percent V has tensile strength of about 100 kg/mm$^2$ and Vickers hardness of about Hv=260. Surface of this material as a workpiece was processed with a $ZrH_2$ green compact electrode whose area is 1.7 cm$^2$ under an electrical condition of Ip=5.5 A and τp=32 μs. Then, the deposited layer on the workpiece had a hardness of Hv=660–690 and a thickness of 10 μm. In case the workpiece surface was further processed by the secondary processing by use of a graphite electrode, it had a hardness of Hv=1350–2000.

The same result was obtained when a Ni—Al—Ti—Nb—Ta alloy was processed with the above mentioned surface treating by electric discharge machining so as to form a coating on its surface.

While many variations of the inventive surface treating method are described above, a workpiece material to be processed, i.e. a counter electrode material facing a discharge electrode for generating electric discharge, may contain a steel, a special steel, a hard metal, a cermet, an aluminum, an aluminum alloy, a zinc, a zinc alloy, a copper, a copper alloy, and a super heat resisting alloy (also called a super alloy) having Ni, Co and the like as its main components. A so-called non-ferrous material or non-ferrous alloy is also an object of the inventive surface treating method.

With the inventive surface treating method, a coating layer having several μm to tens μm thickness and strong adhesion can be formed on a surface of a workpiece such as a steel, a hard metal or the like, by forming metal hydride powders of Ti, Zr, V, Nb, Ta or the like into a green compact electrode and generating electric discharge in a working fluid.

This coating layer has very good abrasion resistance. In addition, roughness of a finished workpiece surface is also better than other comparison examples (WC+Co) under the same electrical conditions, and the surface roughness according to the inventive method is ½ to ⅓ of the surface roughness according to the comparison example method.

If the metal hydride is mixed with $TiB_2$, TiN, TiC, TaC, NbC or VC, the processed workpiece surface has larger hardness.

If a metal like Ta, Nb and V is added to the metal hydride, toughness of the workpiece surface improves. If the secondary processing is performed by a graphite electrode or a copper electrode or the like, the hardness is enlarged by 50 percent to about two times.

What is claimed is:

1. A surface treating method by electric discharge, comprising the steps of:

positioning a discharge electrode so as to face a workpiece, the discharge electrode comprising a compact of compressed powder materials including at least powders of a metal hydride; and generating electric discharge between the discharge electrode and the workpiece in a working fluid containing carbon therein, thereby forming a coating layer containing the metal hydride on a surface of the workpiece.

2. A surface treating method by electric discharge according to claim 1, wherein the working fluid contains a polymeric material which is thermally decomposed to produce carbon.

3. A surface treating method by electric discharge according to claim 1, wherein the polymeric material is one of a mineral fat and oil and a vegetable fat and oil.

4. A surface treating method by electric discharge according to claim 1, wherein the metal of the metal hydride is a transition metal.

5. A surface treating method by electric discharge according to claim 1, wherein the powders of the metal hydride are mixed with at least one of a carbide, a nitride, a boride and powders of at least one of another metal other than the metal of the metal hydride.

6. A surface treating method by electric discharge according to claim 1, wherein the powders of the metal hydride are mixed with at least one of a zirconium powder, a vanadium powder, a niobium powder and a tantalum powder.

7. A surface treating method by electric discharge according to claim 1, wherein the powders of the metal hydride are mixed with powders of a metal of a same kind as the workpiece.

8. A surface treating method by electric discharge according to claim 1, further comprising the steps of:

positioning a non-consumable electrode so as to face the workpiece after the coating layer is formed on the surface of the workpiece; and generating electric discharge between the non-consumable electrode and the workpiece.

9. A surface treating method by electric discharge according to claim 8, wherein the non-consumable electrode is made of one of graphite, copper, tungsten, silver tungsten, copper tungsten, and tungsten carbide.

10. A surface treating method by electric discharge according to claim 1, wherein the workpiece is made of a non-ferrous metal.

11. A surface treating method by electric discharge according to claim 1, wherein the workpiece is made of a super alloy.

* * * * *